United States Patent [19]

Plapp et al.

[11] Patent Number: 4,542,537

[45] Date of Patent: Sep. 24, 1985

[54] NECKTIE CLINCHER

[75] Inventors: Charles D. Plapp, Riverside; Anton Choc, Lombard, both of Ill.

[73] Assignee: Dimple Tie Co., Inc., North Riverside, Ill.

[21] Appl. No.: 496,480

[22] Filed: May 20, 1983

[51] Int. Cl.[4] ..... A41D 25/10

[52] U.S. Cl. ..... 2/148; 2/152 R; 2/152 A; 24/49 KC; D2/351

[58] Field of Search ..... 2/152 R, 152 A, 153, 2/154, 156, 148, 150, 149; 24/49 C, 49 CP, 49 S, 3 L, 3 M, 255 BS, 49 KC; D2/351

[56] References Cited

U.S. PATENT DOCUMENTS

| | | | |
|---|---|---|---|
| 982,948 | 1/1911 | Griesemer | 2/152 A |
| 2,195,373 | 3/1940 | Snyder et al. | 2/148 |
| 2,409,744 | 3/1946 | Edmonson | 2/148 |
| 2,434,821 | 1/1948 | Ulrich | 2/152 A |
| 2,653,325 | 9/1953 | McCarthy | 2/148 |
| 3,235,880 | 2/1966 | Hypps | 2/152 R |

FOREIGN PATENT DOCUMENTS

| | | | |
|---|---|---|---|
| 49927 | 9/1925 | Norway | 24/49 TS |
| 337246 | 10/1930 | United Kingdom | 24/49 S |
| 1567615 | 5/1980 | United Kingdom | 2/152 R |

*Primary Examiner*—Werner H. Schroeder
*Assistant Examiner*—Steven N. Meyers
*Attorney, Agent, or Firm*—Balogh, Osann, Kramer, Dvorak, Genova & Traub

[57] ABSTRACT

A device for obtaining a pleasing effect of the front portion of the necktie extending below a formed knot disposed in an opening defined by collar ends of a wearer's shirt. The device is in the form of a necktie clincher which is adapted to define an elongated dimple on the tie just below the formed knot. The clincher comprises a funnel-like sleeve having a longitudinally-extending slot which interconnects between a flared, necktie-receiving opening and a narrow-tie clinching opening. After the knot is substantially or, in the alternative, completely formed, the necktie clincher is attached to the underside of the front portion of the necktie and slipped upwardly to form an elongated dimple, just below the formed knot, to thereby form a pleasing draped effect. The necktie clincher is pushed upwardly until it is concealed within the knot.

6 Claims, 9 Drawing Figures

NECKTIE CLINCHER

BACKGROUND OF THE INVENTION

1. Field of the Invention

This invention relates generally to neckties, and more particularly to devices for constricting the area of the necktie portion immediate or adjacent a tied knot from which the necktie portion drapes downwardly.

2. Description of the Prior Art

This invention is primarily concerned with neckties of the type known as four-in-hand, which are usually made from an elongated fabric having a relatively wide flared portion, a neck portion, and a slip portion, wherein the neck portion encircles the neck of the wearer and the slip portion forms a base for forming a knot thereabout. It is desirable that, after the knot is tied in the necktie and slipped upwardly to abut the collar on a shirt of the wearer, a drape effect is obtained, wherein the drape flared portion forms an elongated cleft or a dimple extending downwardly from the knot for one or two inches to give a pleasing effect. To obtain this elongated dimple, different means have been proposed. For example, the disclosure in U. S. Pat. No. 2,409,744 describes a necktie in which stiffening material is suitably attached to the flared portion of the necktie for the purposes of developing the elongated dimple in the area just beneath the knot. A similar proposal is described in U. S. Pat. No. 2,653,325, wherein a liner is incorporated in the flared portion of the necktie for developing the draped effect. The disadvantage of the foregoing methods of developing an elongated dimple is in the introduction of an additional component into the necktie construction which is time consuming and costly. Another form for developing a constriction in the form of the elongated dimple adjacent the knot in the necktie is described in U. S. Pat. No. 2,195,373, wherein a dimple forming device is permanently incorporated with the necktie and slidably supported thereon so that, after the knot is tied, the device can be slipped upwardly into the knot to be concealed thereby. The disadvantage of a permanently supported dimple-forming device is apparent, namely that the device causes creases and rumpling to develop in the necktie since it remains on the necktie at all times. Furthermore, substantial wear of the necktie occurs along the edges of the necktie due to the continuous movement of the device along the length of the necktie as it is being used by the wearer day after day.

SUMMARY OF THE INVENTION

To overcome the foregoing disadvantages, the main object of the invention is to provide means operative to constrict the material of the necktie symmetrically and independently of the constriction imposed by the knot itself, thereby to produce a pleasing drape effect by forming a longitudinally-extending central depression or a dimple just below the knot, as well as to provide means operative to ensure retention of the initial drape effect during the wearing of the necktie. A necktie clincher comprises a funnel-like sleeve provided with a longitudinally-extending slot having a flared opening adapted to be slipped over the flared portion of the necktie, onto the undersurface of the necktie when the necktie is pinched or creased into a "U-shape" along the longitudinal mid-line of the flared portion.

Another object of the invention is to provide a necktie clincher made of material having a low friction coefficient to minimize wear on the necktie.

A still further object of the invention is to provide a removable necktie clincher which can be readily engaged with the flared portion of the necktie and easily slipped upwardly into the knot to be concealed thereby.

These and other objects of the invention will become apparent from a study of the following description in which reference is directed to the attached drawings.

DESCRIPTION OF THE PREFERRED EMBODIMENT

Figure 1:
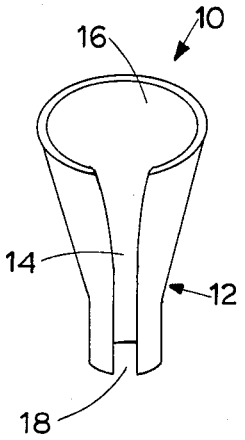
FIG. 1 is a perspective view of a necktie clincher.
Figure 2:
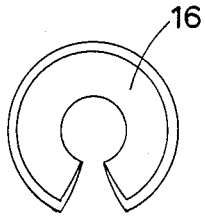
FIG. 2 is a top view of the necktie clincher shown in FIG. 1.
Figure 3:
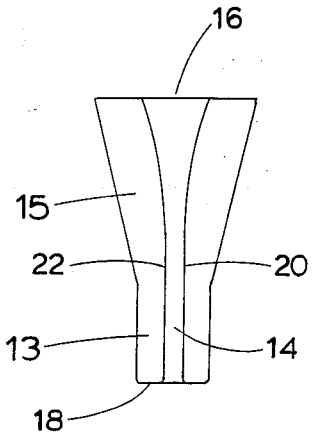
FIG. 3 is a side view of the necktie clincher.
Figure 4:
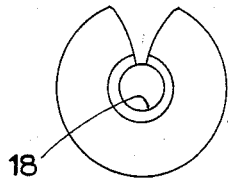
FIG. 4 is a bottom view of the necktie clincher shown in FIG. 1.

Referring to FIGS. 1–4, the physical structure of a necktie clincher 10 is illustrated. The necktie clincher 10 comprises essentially a funnel-like sleeve 12 provided with a longitudinally-extending slot 14 extending between a flared, necktie-receiving opening 16 and a narrow tie-clinching opening 18. The sleeve 12 has a tubular portion 13 integrally formed with a conically formed flared portion 15. The necktie clincher 10 is made from any suitable plastic material, for example, polyethylene or vinyl, which possesses sufficient resiliency so that walls 20 and 22 defining the slot 14 will slightly pry apart upon insertion of a creased necktie.

Although the necktie clincher is particularly adapted for use with four-in-hand ties, it is apparent that it can be used with neckties having narrower construction. Although the necktie clincher is ideally adapted for use with a tie having a half-Windsor knot,it can be used with ties having differently developed knots.

Figure 5A:
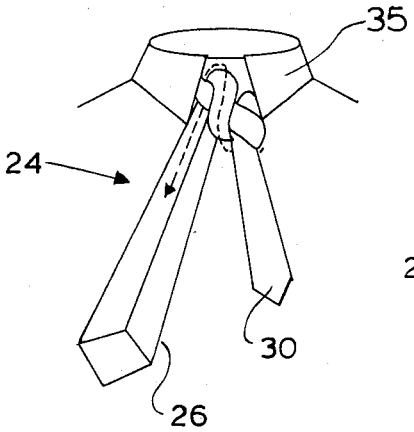
FIG. 5 illustrates the tying of the necktie and the placement of the necktie clincher on the necktie.
Figure 5B:
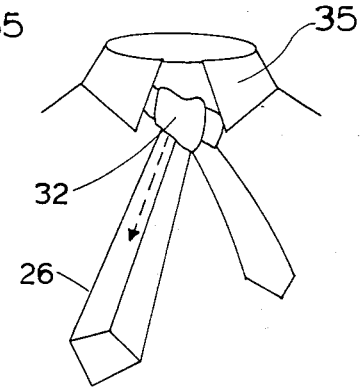
Figure 5C:
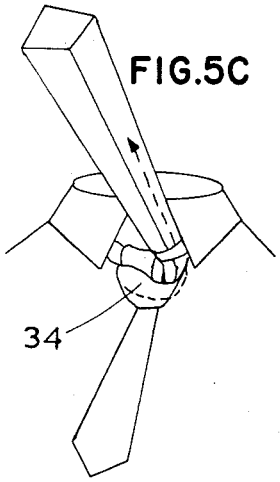
Figure 5D:
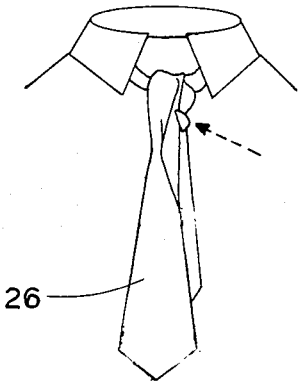
Figure 5E:
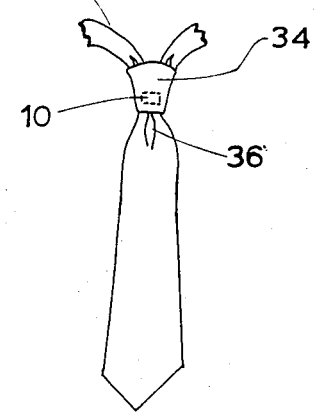

Referring to FIG. 5, several stages are shown for forming a half-Windsor knot on a necktie. A necktie 24 comprises a flared portion 26, a neck portion 28, and a slip portion 30. After the flared portion 26 is looped around the slip portion 30 to form a first stage knot 32, the knot is then slipped upwardly into a collar 35, as shown in FIG. 5(B). Thereafter, the flared portion 26 is laid over the first stage knot 32 to form a second stage knot 34, and then brought outwardly underneath the neck portion, as shown in FIG. 5(C), and then permitted to hang loosely as shown in FIG. 5(D). At this time, the necktie clincher 10 is attached underneath the flared portion 26, below the second stage knot 34 by pinching or folding the flared portion 26 so that the flared necktie-receiving opening 16 of the necktie clincher 10 can be slipped over the pinched material of the necktie. Thereafter, the flared portion 26 is inserted under the second stage knot 34 to complete the half-Windsor knot. Then the flared portion 26 is pulled downwardly to snug up the knot. Subsequently, the clincher 10 is slipped upwardly and into the knot to form an elongated dimple 36 as shown in FIG. 5(E). Alternatively, the knot may be completely formed to have the appearance shown in FIG. 5(E) before the necktie clincher is applied to the flared portion 28. Thereafter, the necktie clincher would be pushed upwardly and into the knot to be concealed thereby.

Although an embodiment of the invention has been described with some particularity, many modifications and variations in the invention are possible within the light of the above teachings. It is, therefore, to be understood that, within the scope of the appendent claims, the invention may be practiced other than as specifically described.

What is claimed is:

1. A necktie clincher for use with a necktie, such as a four-in-hand type necktie having a longitudinal flared portion and a longitudinal slip portion interconnected by a neck portion and designed to be tied around a wearer's neck in a knot having one or more stages, said clincher being adapted to constrict the flared portion adjacent the knot to develop an elongated dimple, said clincher comprising a funnel-like sleeve, said sleeve having a flared necktie-receiving opening at one end and a narrow necktie-clinching opening at the other end, and a pair of walls defining a slot extending longitudinally along said sleeve and communicating with both of said openings, wherein said flared opening is adapted to initially receive an underside of the flared portion when it is creased along its longitudinal mid-line so that said sleeve may be slipped upwardly along the crease into the formed knot, to be concealed thereby.

2. A necktie clincher according to claim 1, wherein said sleeve is made from material having a low friction coefficient to facilitate engagement with the flared portion and movement along the crease.

3. A necktie clincher according to claim 2, wherein said material exhibits resiliency, whereby the width of the slot will enlarge slightly to admit necktie fabric and thereafter effectively maintain a clamped position on the necktie.

4. A necktie clincher for developing an elongated dimple in the front portion of the necktie as it drapes below a formed knot, comprising a longitudinally slotted body having a tubular portion integrally formed with a conically flared portion, said tubular portion having a constricted opening and said flared portion having a flared opening for receiving a creased underside of the front portion of the necktie when it is creased along the longitudinal mid-line of the necktie to form an elongated dimple, so that the clincher, after it has been secured to the crease, may be slipped upwardly along the crease into the formed knot to be concealed thereby, thereby positioning said dimple just below the formed knot.

5. A necktie clincher, according to claim 4, wherein the portion of said slot in the flared portion flares outwardly to facilitate the mounting of said clincher on the crease in the necktie.

6. A necktie clincher, according to claim 4, wherein said body is molded from material having a low friction coefficient to facilitate the engagement with the creased necktie and to facilitate subsequent movement of said body toward and into said knot.

* * * * *